US008276609B2

(12) United States Patent
Frey

(10) Patent No.: US 8,276,609 B2
(45) Date of Patent: Oct. 2, 2012

(54) CONCEALED PLUMBING FIXTURE

(75) Inventor: Christof Frey, Salach (DE)

(73) Assignee: Hansa Metallwerke AG (DE)

( * ) Notice: Subject to any disclaimer, the term of this patent is extended or adjusted under 35 U.S.C. 154(b) by 655 days.

(21) Appl. No.: 11/660,285

(22) PCT Filed: Aug. 16, 2005

(86) PCT No.: PCT/EP2005/008882
§ 371 (c)(1),
(2), (4) Date: Apr. 7, 2008

(87) PCT Pub. No.: WO2006/018247
PCT Pub. Date: Feb. 23, 2006

(65) Prior Publication Data

US 2008/0252073 A1 Oct. 16, 2008

(30) Foreign Application Priority Data

Aug. 19, 2004 (DE) ..... 10 2004 040 084

(51) Int. Cl.
*E03C 1/042* (2006.01)

(52) U.S. Cl. ..... 137/359; 137/360; 251/367; 285/330

(58) Field of Classification Search ..... 137/359–360; 285/330; 251/367
See application file for complete search history.

(56) References Cited

U.S. PATENT DOCUMENTS

| | | | | |
|---|---|---|---|---|
| 1,562,982 | A * | 11/1925 | Muend | 285/18 |
| 1,592,093 | A * | 7/1926 | Foucault | 285/325 |
| 2,143,517 | A * | 1/1939 | Huff | 220/3.5 |
| 4,979,538 | A | 12/1990 | Krippendorf et al. | |
| 5,934,032 | A | 8/1999 | Oberdorfer | |
| 5,947,147 | A | 9/1999 | Gnauert et al. | |
| 2004/0050423 | A1 * | 3/2004 | Schoenweger | 137/360 |

FOREIGN PATENT DOCUMENTS

| | | | |
|---|---|---|---|
| DE | 3301060 | A1 | 8/1983 |
| DE | 9311444.3 | U1 | 12/1993 |
| DE | 19648587 | A1 | 4/2004 |
| EP | 0389810 | A1 | 10/1990 |
| EP | 0818585 | A2 | 1/1998 |
| EP | 0844340 | A1 | 5/1998 |
| EP | 1382757 | A1 | 1/2004 |

* cited by examiner

*Primary Examiner* — John Bastianelli
(74) *Attorney, Agent, or Firm* — Factor Intellectual Property Law Group, Ltd.

(57) ABSTRACT

Disclosed is a concealed plumbing fixture including a connection member that is provided with at least one connection for a water pipe, especially a domestic cold water pipe and/or a domestic warm water pipe, and at least one fastening element for fixing the connecting member in a mounting hole. Said plumbing fixture further includes a functional unit, particularly with a plumbing valve that is provided with connection means for creating a water connection to complementary connecting means of the connecting member, and a joining device that allows the functional unit to be removably fixed to the connecting member. The connecting member is preferably provided with an adjustable fastening device by means of which the same can be fixed in the mounting hole at different mounting depths. The inventive plumbing fixture also includes at least one fastening ring that can be moved in an axial direction along the connecting member as well as at least one means for locking the fastening ring on the connecting member.

9 Claims, 6 Drawing Sheets

CONCEALED PLUMBING FIXTURE

RELATED APPLICATIONS

This application claims the filing benefit of PCT Patent Application PCT/EP2005/008882, filed Aug. 16, 2005; which claims the filing benefit of DE 102004040084.9, filed Aug. 19, 2004; of which the contents of these applications are incorporated herein by reference.

TECHNICAL FIELD

The invention relates to a concealed plumbing fixture having

- a connecting member which has at least one connection for a water pipe, in particular a domestic cold water pipe and/or a domestic hot water pipe, and at least one fastening element for fastening the connecting member in an installation opening;
- a functional unit, in particular with a sanitary valve, which has connecting means for water connection to complementary connecting means of the connecting member; and,
- a connecting device, by which the functional unit can be releasably fastened to the connecting member.

BACKGROUND OF THE INVENTION

Recently, increasing use has been made of concealed plumbing fixtures, where the building owner can postpone his decision on the precise type of concealed plumbing fixture he desires until the final phase of interior works on a building. First of all, simply a universally usable connecting member is installed in an installation opening of the building wall, for example a wall recess, and is connected to the water pipes laid in the building wall, thus in particular the domestic cold water pipe, the domestic hot water pipe and optionally mixed-water-discharging pipes. The wall recess thus equipped is then covered until the interior works on the building have been largely completed. Only then is the covering of the wall recess removed again. The building owner now decides which specific type of concealed fitting he desires, for example a single-lever mixer, thermostatic valve or the like. The manufacturer of the concealed fixture has available a complete set of functional units which are standardised such that they can all be connected to the same connecting member, but contain different sanitary valves. The specific functional unit desired by the building owner is then connected to the connecting member; finally, all that is required is to fit the rosette, which covers the wall recess, and the operating elements.

Since the depth of the wall recess and the depth at which the domestic pipes are laid in the wall vary, the way in which the connecting member is fastened in the wall recess must likewise be variable. In known concealed plumbing fixtures of the type mentioned at the beginning, the connecting member is adapted to the wall recess by fitting in wooden supports or similar mounts, the installation depth of the connecting member in the wall recess in particular being varied in this way. However, the adaptation with such wooden supports, which are only to be provided on site, is relatively time-consuming.

Adapting the fastening of the connecting element on wall linings, pre-wall systems or the like, to achieve an optimal installation depth, is not possible at all in this way.

SUMMARY OF THE INVENTION

The present invention is provided to address these and other considerations.

An object of the present invention is to design a concealed fixture of the type mentioned at the beginning in such a way that the connecting element can be adapted to different mounting situations and can be installed in these situations quickly and in a technically simple manner.

This object is achieved according to one embodiment of the invention in that the connecting member has an adjustable fastening device, by which the connecting member can be fastened in the installation opening at different installation depths, and comprises

- at least one fastening ring displaceable in the axial direction along the connecting member, and,
- at least one locking means for locking the fastening ring on the connecting member.

According to the present invention, therefore, provision is made for a fastening device by which the connecting member can be installed on site in different installation opening in a technically simple and precise manner. This fastening device enables the connecting element to be mounted such that it is adapted to different construction methods, for example conventional facings, pre-wall systems or timber stud walls. Complicated and time-consuming adaptation often with temporary means, such as, for example, wooden supports and similar mounts, is thus not necessary. By means of the fastening device, the installation depth of the connecting member can always be precisely adjusted in the installation opening without additional aids. The fastening device also makes it possible to correct errors on installation in a prefabricated wall arrangement, for example an incorrect installation depth and/or inclined installation of the connecting member.

In another embodiment of the present invention, the fastening ring has at least one radially inwardly projecting bayonet catch and is arranged so as to be axially displaceable along the connecting member and rotatable at least in a sub-region of the connecting member, and the connecting member has at least one circular-arc-shaped locking groove for receiving the bayonet catch. A fastening device having a bayonet catch can be produced in a technically simple manner and enables reliable and stable connection to the connecting member. By rotation of the fastening ring, during which the bayonet catch is pushed into the respective locking groove, the fastening ring can be stably locked.

To prevent the fastening ring from twisting on displacement along the connecting member, in a further advantageous embodiment the connecting member has at least one guide element, in particular a guide groove, for the fastening ring.

Different installation depths can be realised in a further advantageous embodiment by the fact that a multiplicity of locking grooves are arranged one behind the other.

In order to be able to dispense with additional fastening means, for example special screws, in a further advantageous embodiment the fastening ring has the same fastening element as the connecting member.

A particularly advantageous embodiment provides that the fastening ring has at least two mutually complementary coupling means, by which it can be coupled to a second identical fastening ring, so that, in particular, large installation depths can be realised by placing a multiplicity of standardised fastening rings one behind the other.

Expediently, an advantageous embodiment provides that a first coupling means is a ring collar running around on one of the two end faces of the fastening ring and a second coupling means is a ring groove running around in the other end face and complementary to the ring collar, so that the two fastening rings can be fitted together in a technically simple manner.

In order to enable greater variation of the installation depth, a further advantageous embodiment provides that the rear side of the connecting member has a further coupling means which is complementary to one of the coupling means and by which at least one of the fastening rings can be coupled to the rear side. In this way, the fastening rings can also be fitted onto the connecting member from the rear side.

BRIEF DESCRIPTION OF THE DRAWINGS

An exemplary embodiment of the invention is explained in more detail below with reference to the drawing, in which The invention is explained more fully in the following with reference to an exemplary embodiment and the drawings.

DETAILED DESCRIPTION OF THE PRESENT INVENTION

Figure 1:
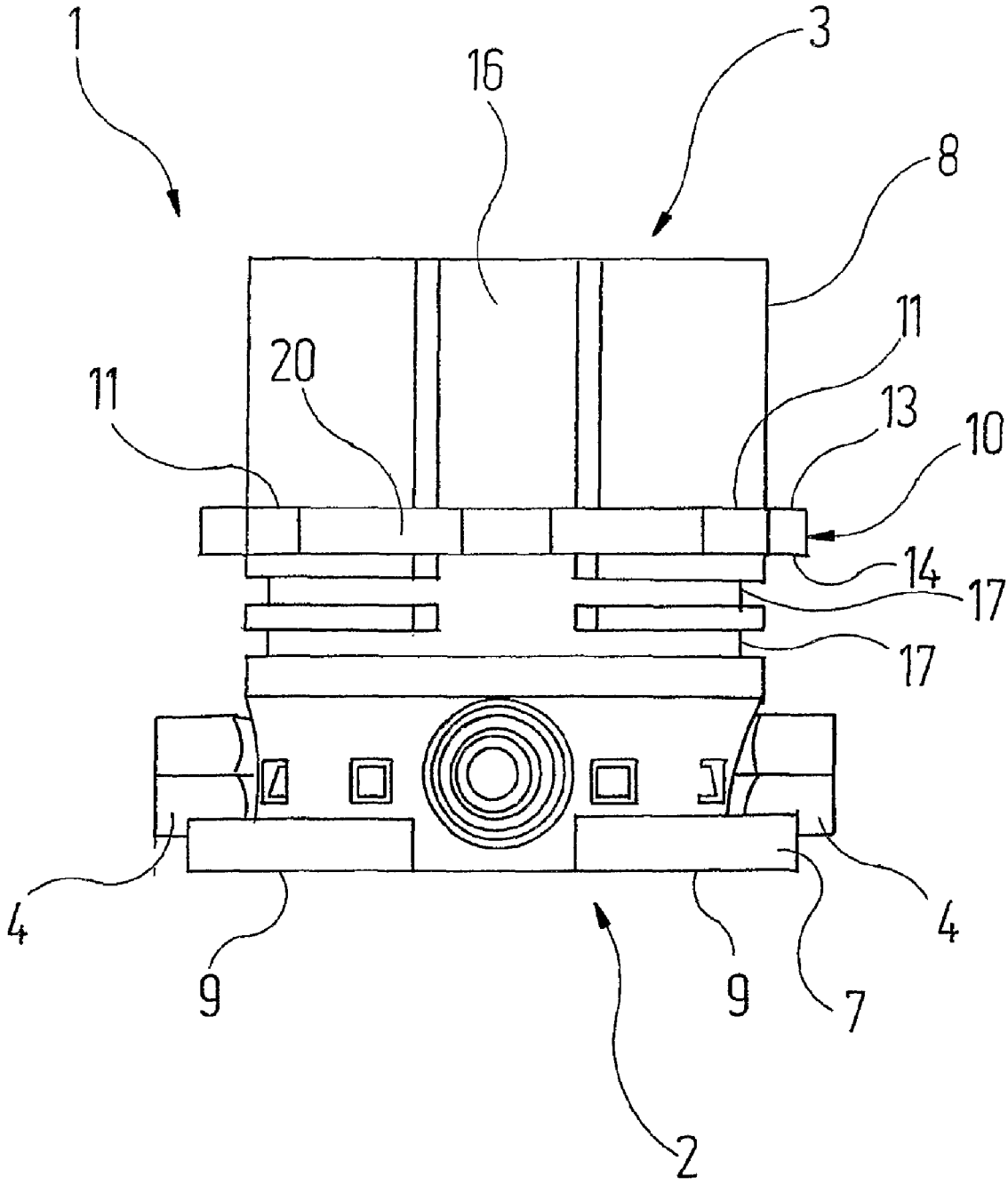
FIG. 1 schematically shows the side view of a first exemplary embodiment of a connecting member for a concealed plumbing fixture with a fastening ring for mounting in a wall installation opening.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Illustrated in FIG. 1 is a first exemplary embodiment of a connecting member, provided as a whole with the reference symbol 1, for a concealed plumbing fixture for mounting in a wall installation opening. A functional unit (not illustrated), for example a single-lever mixer, a thermostatic mixer or a two-handle mixer, can be connected to the connecting member 1 in a manner known per se and fastened by a customary connecting device (not illustrated).

The connecting member 1 has essentially the form of a hollow cylinder which is closed at its rear side 2, at the bottom in FIG. 1, and is open at the front region 3, at the top in FIG. 1.

In the region of the rear side 2, four connecting pieces 4 are radially inserted in the connecting member 1. The connecting pieces 4 can be integral parts of the connecting member 1, but also parts to be connected separately thereto. The connecting pieces 4 can be connected in a manner known per se to water pipes (not illustrated) laid in the wall.

Figure 3:
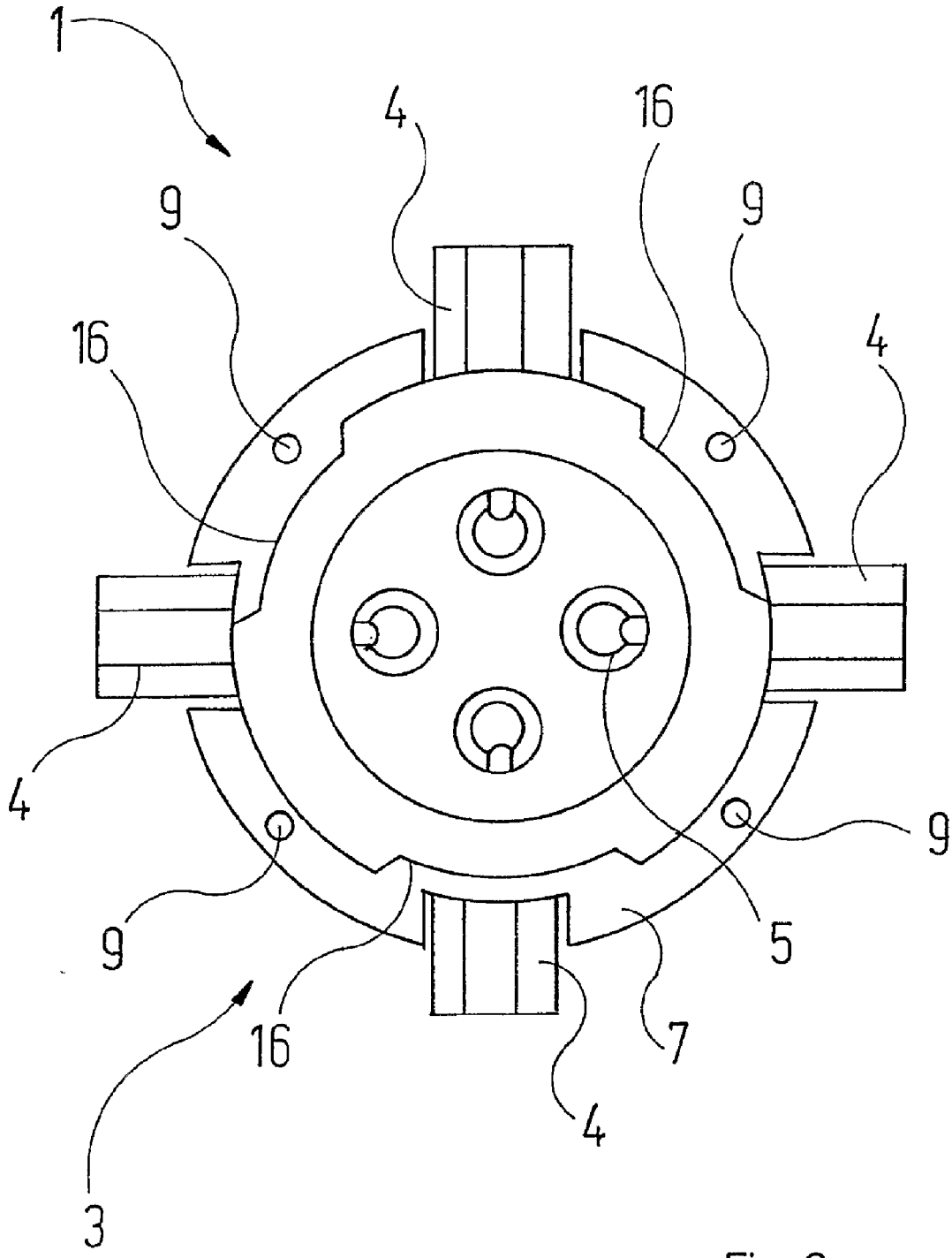
FIG. 3 schematically shows the top view of the connecting member illustrated in FIG. 1, without the fastening ring.

As illustrated in the front view in FIG. 3, four connecting openings 5 assigned respectively to the connecting pieces 4 are provided inside the connecting member 1. At these connecting openings 5, the respective functional unit can be water-connected in a manner known per se to the connecting member 1.

In order to be able to fasten the connecting member 1 in the wall at an installation depth corresponding to a customary standard, the connecting member 1 has, in FIG. 1 below the connecting pieces 4, a rear fastening collar 7 which is interrupted in each case in the region of the connecting pieces 4.

Figure 4:
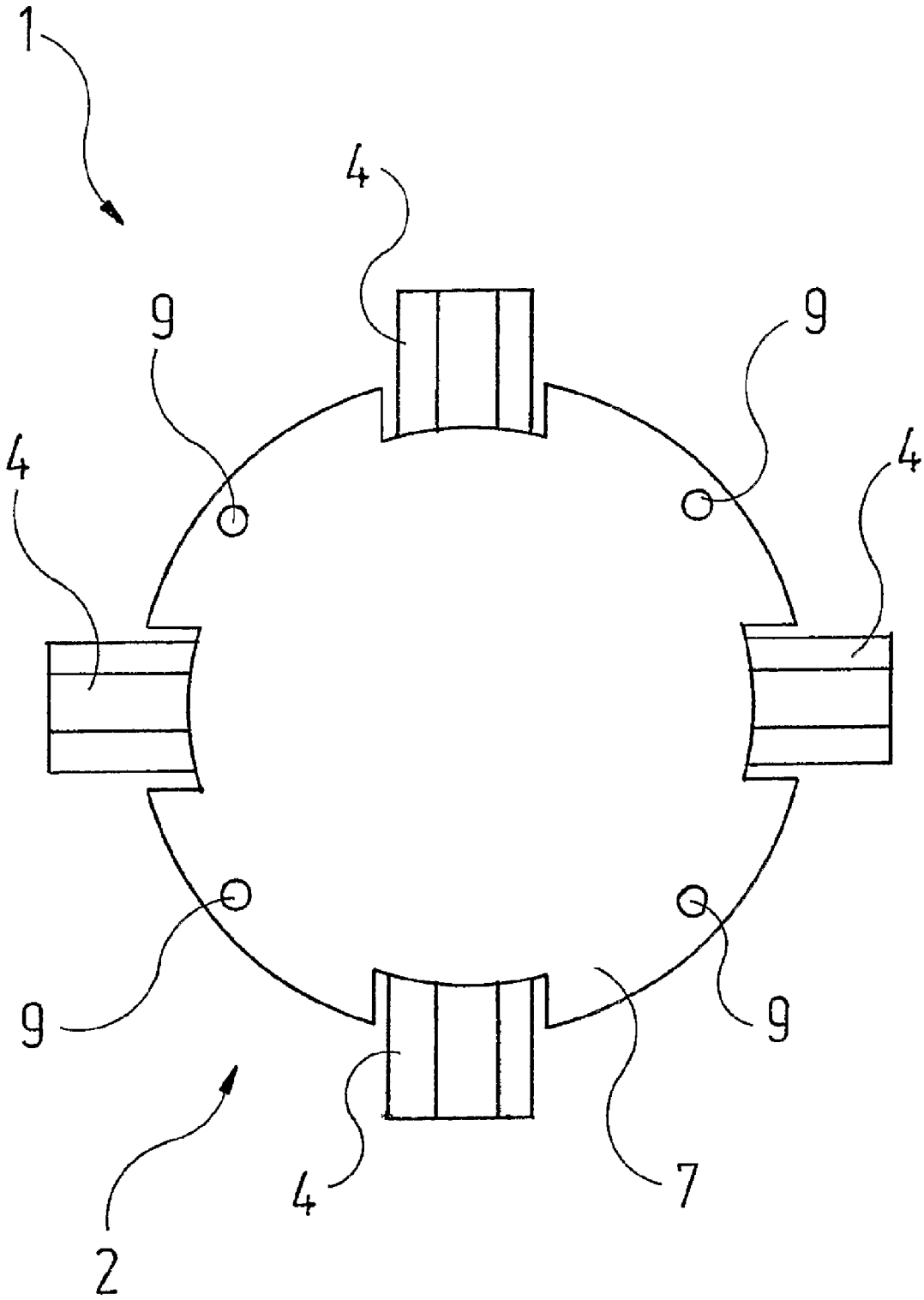
FIG. 4 schematically shows the bottom view of the connecting member illustrated in FIG. 1, without the fastening ring.

The fastening collar 7 projects radially beyond the outer lateral surface 8 of the connecting member 1. In the fastening collar 7 there are arranged, at each of the corners of an imaginary square in FIG. 4, four passing-through collar-fastening bores 9 as fastening elements. The axes of the collar-fastening bores 9 run parallel to the imaginary axis of the connecting member 1.

Screws (not illustrated), by which the connecting member 1 can be screwed in a manner known per se in the wall, can be inserted into the collar-fastening bores 9.

In the front region 3 of the connecting member 1, a front fastening ring 10 is arranged so as to be displaceable in the direction of the axis of the connecting member 1, upwards and downwards in FIG. 1, the installation depth of the connecting member 1 in the wall being variable by means of this fastening ring.

Figure 2:
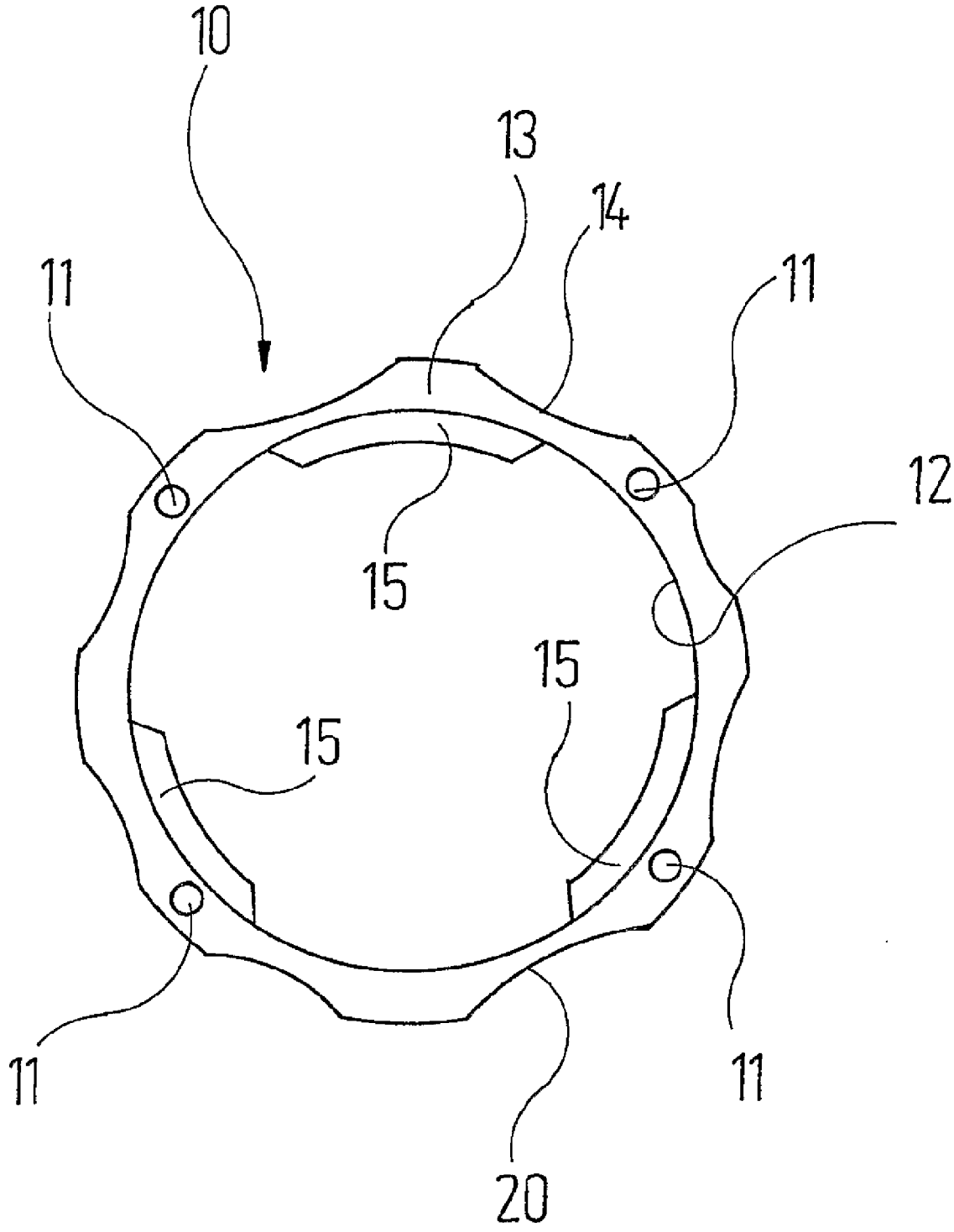
FIG. 2 schematically shows the top view of the fastening ring illustrated in FIG. 1.

The front fastening ring 10 has ring-fastening bores 11, visible in FIG. 2, which are identical in their shape and their arrangement to the collar-fastening bores 9. In order to achieve different installation depths, the connecting member 1 can thus be fastened in the wall installation opening either by the rear fastening collar 7 or by the front fastening ring 10.

On the inner lateral surface 12 of the front fastening ring 10, midway between its two end faces 13, 14, there are formed, in a manner projecting radially inwards, three bayonet catches 15 as locking means, (cf. FIG. 2).

The bayonet catches 15 form segments of an imaginary hollow cylinder, the outer lateral surface of which borders on the inner lateral surface 12 of the front fastening ring 10 and is firmly connected thereto or emerges integrally therefrom. The mid-points of the arcs spanned by the bayonet catches 15 form the corners of an equilateral triangle arranged in a plane parallel to the end faces 13, 14 of the fastening ring 10. The arc length of the bayonet catches 15 corresponds in each case to a central angle of 30°. The bayonet catches 15 are half as high as the front fastening ring 10 in the axial direction. They are approximately half as wide as the fastening ring 10 in the radial direction.

In the outer lateral surface 8 of the front region 3 of the connecting member 1 there are provided three guide grooves 16, complementary to the bayonet catches 15, as guide means for the front fastening ring 10, the guide grooves running in the axial direction from the outer end of the front region 3 of the connecting member 1 as far as a region above the connecting pieces 4. The guide grooves 16 run over a somewhat greater arc length than the bayonet catches 15. The depths of the guide grooves 16 are somewhat greater than the widths of the bayonet catches 15. On displacement of the front fastening ring 10 along the front region 3 axially with respect to the connecting member 1, the bayonet catches 15 are guided in the guide grooves 16.

In the region directly above the connecting pieces 4 in FIG. 1, three complementary locking grooves 17 with identical dimensions are formed annularly in the outer lateral surface 8 of the connecting member 1—the front locking groove 17 is hidden by the front fastening ring 10 in FIG. 1. The depth of the locking grooves 17 in the radial direction is somewhat greater than the width of the bayonet catches 15, their width in the axial direction is somewhat greater than the height of the bayonet catches 15, so that the bayonet catches 15 fit into the locking grooves 15 in a form-fitting manner.

By rotation of the front fastening ring 10 relative to the connecting member 1, the bayonet catches 15 can be pushed into the locking grooves 17, in order to prevent displacement of the front fastening ring 10 in the direction of the axis of the connecting member 1 and lock the front fastening ring 10.

The distance between two adjacent locking grooves 17 corresponds to half the height of the fastening ring 10, so that two fastening rings 10 one behind the other can be simultaneously locked on the front region 3 of the connecting member 1.

Furthermore, at regular intervals along the outer lateral surfaces of the fastening ring 10 there are provided a multiplicity of gripping depressions 20, by which the fastening ring 10 can be comfortably rotated by hand. Otherwise, the fastening ring 10 has essentially the same geometry as the rear fastening collar 7.

In order to adjust the installation depth in the recess on mounting the connecting member 1, a fastening ring 10 is pushed from the front region 3 of the connecting member 1 along the guide groove 16 on the connecting member 1 and, by rotation, fixed in the corresponding locking groove 17.

Subsequently, the fastening ring 10 and with it the connecting member 1 is fastened in the wall in a manner known per se by screws (not illustrated) through the ring-fastening bores 11.

Figure 5:
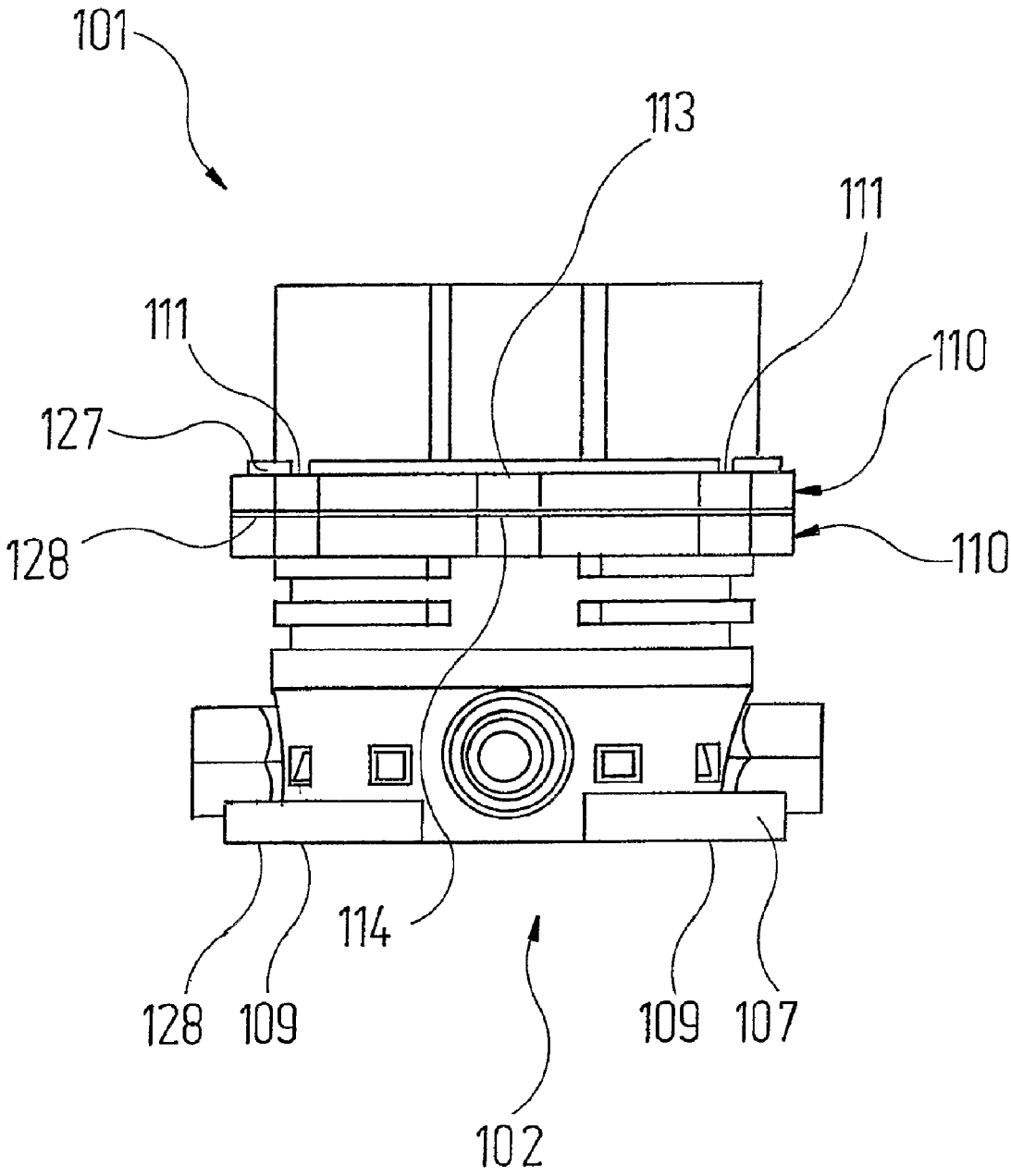
FIG. 5 schematically shows the side view of a second exemplary embodiment of a connecting member, in which two fastening rings are fitted on top of one another; and, FIG. 6 schematically shows the top view of one of the fastening rings illustrated in FIG. 5.

A second exemplary embodiment of the invention is illustrated in FIG. 5. It differs from the first exemplary embodiment merely by the fact that, instead of the fastening ring 10, two identical fastening rings 110 are placed on top of one another in the second exemplary embodiment.

Figure 6:
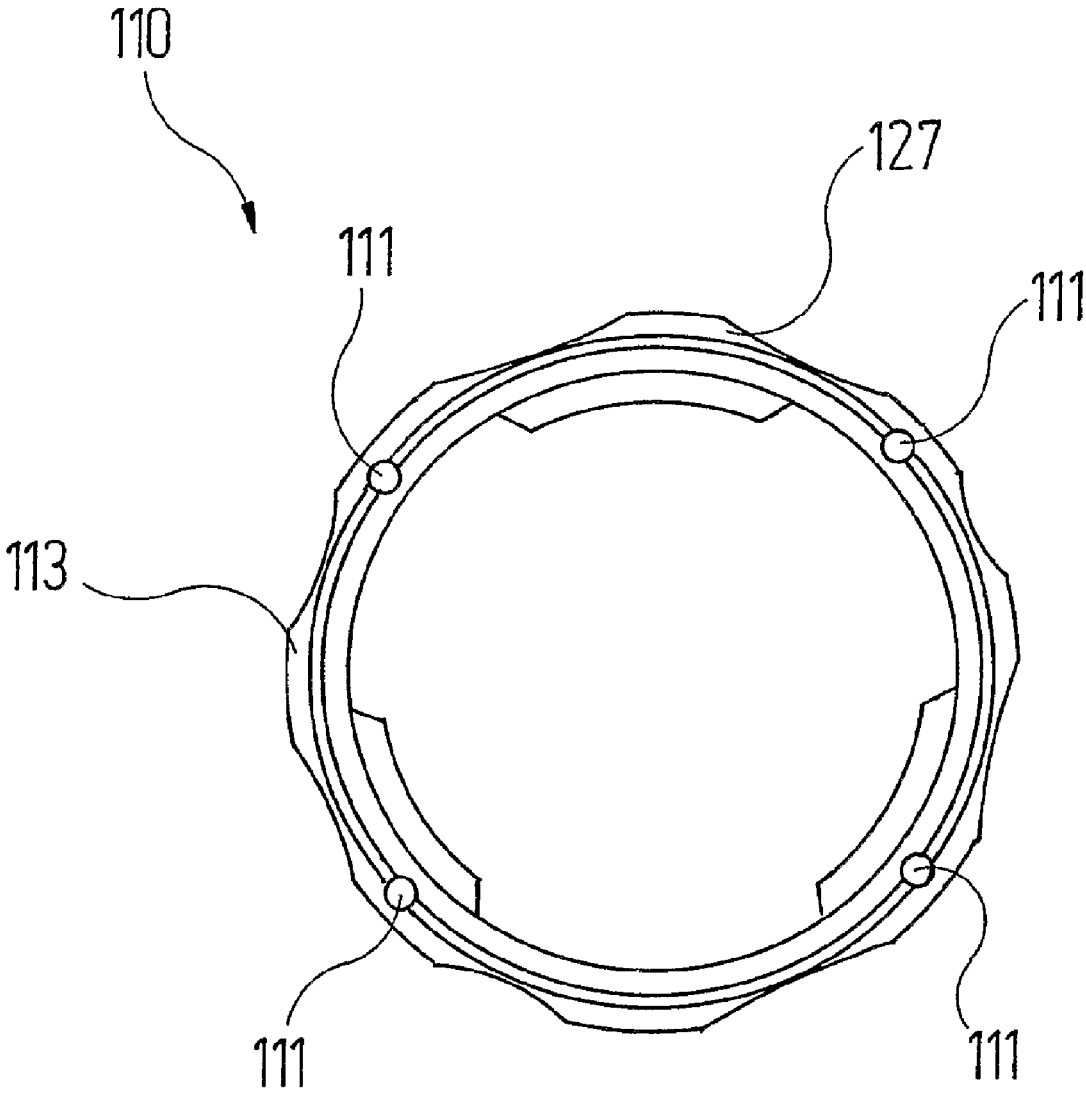

The fastening rings 110 in the second exemplary embodiment differ from the fastening ring 10 in the first exemplary embodiment merely by the fact that they each have, running around on their, in FIG. 5 upper, annular end faces 113, a ring collar 127, illustrated as a top view in FIG. 6, which is in each case interrupted by ring-fastening bores 111 corresponding to the ring-fastening bores 11 in the first exemplary embodiment, and which serves as a first coupling means for coupling two fastening rings 110.

The ring collar 127 has the form of a hollow cylinder which is placed on the upper end face 113, midway between the inner lateral surface of the fastening ring 110 and an outer lateral surface, and is firmly connected to or integrally formed on this end face.

Running around in the lower end face 114 of the fastening ring 110 there is arranged a ring groove 128, complementary to the ring collar 127, as a second coupling means, into which the ring collar 127 of the, in FIG. 5 lower, fastening ring 110 of the fastening ring pair 110 is fitted.

Furthermore, in a rear fastening collar 107 on the rear side 102 of the connecting member 101, which essentially corresponds to the rear fastening collar 7 in the first exemplary embodiment, there is likewise arranged a ring groove 129 complementary to the ring collar 128 of the fastening ring 110, so that (not illustrated in the figure) at least one of the fastening rings 110 can be fitted onto the rear fastening collar 107. The ring groove 129 running around is interrupted by four collar-fastening bores 109 corresponding to the collar-fastening bores 9.

By fitting on or fitting together one or more fastening rings 110, the distance between a front, in FIG. 5 upper, fastening possibility, namely the upper fastening ring 110, and a rear fastening possibility, in FIG. 5 the fastening collar 7 or at least one further fastening ring 110 fitted thereon (not illustrated), can be increased, thereby allowing greater variation of the installation depth.

Instead of the fastening bores 9, 11; 109, 111, provision may also be made for eyes or lugs, also in a different number, by which the connecting members 1; 101 and the fastening rings 10, 110, respectively, can be fastened in the wall installation opening or the like.

The fastening rings 10, 110 can also be locked in another way, for example by bolts, instead of by a bayonet fastening. Provision may also be made for more or less than three bayonet catches.

Provision may also be made, for example, for a pin/hole pairs or the like instead of the ring collars 127 and the ring grooves 128, by which two fastening rings 110 can be connected to one another.

The connecting member 1; 101 can be installed in conventional facings, a pre-wall system, a timber stud wall, a floor recess, a prefabricated house plumbing system or another type of wall installation.

The invention claimed is:

1. A concealed fixture comprising:

a connecting member, the connected member having:

at least one fastening element for fastening the connecting member in an installation opening, which fastening element is formed integrally with the connecting member;

an adjustable fastening device by which the connecting member can be fastened in the installation opening at different installation depths, the fastening device including at least one fastening ring displaceable in the axial direction along the connecting member; and, at least one locking means for locking the fastening ring on the connecting member;

a functional unit, which has connecting means for water connection to complementary connecting means of the connecting member; and, a connecting device, by which the functional unit can be releasably fastened to the connecting member; and, wherein the connecting member has at least one connection for a water pipe, which connection is connected outside of the connecting member to the water pipe and inside the connecting member to the functional unit.

2. The concealed fixture of claim 1, wherein the fastening ring has at least one radially inwardly projecting bayonet catch and is arranged so as to be axially displaceable along the connecting member and rotatable at least in a sub-region of the connecting member, and in that the connecting member has at least one circular-arc-shaped locking groove for receiving the bayonet catch.

3. The concealed fixture of claim 1, wherein the connecting member has at least one guide element for the fastening ring.

4. The concealed fixture of claim 1, further comprising a multiplicity of locking grooves arranged one behind the other.

5. The concealed fixture of claim 1, wherein the fastening ring has the same fastening element as the connecting member.

6. The concealed fixture of claim 1, wherein the fastening ring has at least two mutually complementary coupling means, by which it can be coupled to a second identical fastening ring.

7. The concealed fixture of claim 6, wherein at least two mutually complementary coupling means includes a first coupling means being a ring collar running around on one of the two end faces of the fastening ring and a second coupling means being a ring groove running around in the other end face and complementary to the ring collar.

8. The concealed fixture of claim 6 wherein the rear side of the connecting member has a further coupling means which is complementary to one of the coupling means and by which at least one of the fastening rings can be coupled to the rear side.

9. The concealed fixture of claim 1, wherein the functional unit is a sanitary valve.

* * * * *